United States Patent [19]

Murai

[11] 4,257,160

[45] Mar. 24, 1981

[54] TWO-BLADED SAFETY RAZOR

[75] Inventor: Yosiichi Murai, Seki, Japan

[73] Assignee: Kai Cutlery Center Co., Ltd., Seki, Japan

[21] Appl. No.: 110,675

[22] Filed: Jan. 9, 1980

[30] Foreign Application Priority Data

Feb. 14, 1979 [JP] Japan ..... 54-14969

[51] Int. Cl.[3] ..... B26B 21/06; B26B 21/22; B26B 21/40

[52] U.S. Cl. ..... 30/41; 30/50

[58] Field of Search ..... 30/41, 47, 50, 61–63

[56] References Cited

U.S. PATENT DOCUMENTS 4,047,296 9/1977 Ishida ..... 30/41

FOREIGN PATENT DOCUMENTS 2902843 8/1979 Fed. Rep. of Germany ..... 30/47
51-70692 3/1976 Japan ..... 30/41
52-22791 2/1977 Japan ..... 30/41
54-13784 1/1979 Japan ..... 30/41

*Primary Examiner*—Gary L. Smith
*Attorney, Agent, or Firm*—Norbert P. Holler; Philip Rodman

[57] ABSTRACT

A two-bladed safety razor has a platform unitary with the handle of the razor. The platform movably supports a blade carrier plate which in turn fixedly carries a shaving blade unit including an upper blade, lower blade and a spacer member interposed between the upper and lower blades. A cap member overlying the upper blade is connected to the platform. Between the upper and lower blades, interposed is an ejecting member which is fixed to at least one of the cap member and the platform. Means are provided for causing a movement of the blade carrier plate and, hence, of the shaving blade unit to and from a fully retracted position relatively to the ejecting member. The ejecting member is so located that the cutting edge of the lower blade is positioned flush with or behind the front surface of the ejecting member when the blade assembly takes the fully retracted position. As the blade carrying member and, accordingly, the shaving blade unit are moved to the fully retracted position, the ejecting member comes into the space between the cutting edges of the blades to eject the hairs and other shaved matters from the space between the cutting edges. When the shaving blade unit takes the fully retracted position, the cutting edges are completely hidden behind the cap member to enhance the safety during handling of the razor.

5 Claims, 8 Drawing Figures

TWO-BLADED SAFETY RAZOR

BACKGROUND OF THE INVENTION

The present invention relates to a two-bladed safety razor and, more particularly, to an improvement in the two-bladed safety razor having a function of ejecting shaved hair and other shaved matters deposited in and clogging the space between the cutting edges of the two blades.

A two-bladed safety razor is known in which hairs and other shaved matters are ejected from the space between the cutting edges of two blades by an ejecting member movably disposed between the two blades. This type of safety razor is disclosed, for example, in the specification of the U.S. Pat. No. 4,047,296. In this safety razor, the ejecting member is normally held at a retracted position behind the cutting edges and is supported by a resilient member. As a manual force is exerted on the resilient supporting member, the ejecting member is projected to the advanced position to expel the hairs and other shaved matters from the space between the cutting edges. As the resilient supporting member is released from the manual force, the ejecting member is automatically retracted by the resiliency of the resilient supporting member.

In this safety razor disclosed in the above-mentioned U.S. Patent, the blades are not moved during the shaving and during the ejection of the hairs and other shaved matters, and are always exposed to the outside of the safety razor. As a result, users of the safety razor are often injured at their hands by the exposed cutting edges of the blades, during handling of the safety razor.

SUMMARY OF THE INVENTION

It is, therefore, an object of the invention to provide a two-bladed safety razor in which the blades can be retracted into the razor body to make the cutting edges disappear, thereby to enhance the safety of the razor.

It is another object of the invention to provide a two-bladed safety razor in which the hairs and other shaved matters deposited in and clogging the space between the cutting edges of two blades are ejected from the space as the blades are moved to the retracted position.

To these ends, according to the invention, there is provided a two-bladed safety razor having a shaving blade unit including an upper blade, a lower blade and a spacer disposed between said upper and lower blades, the shaving blade unit being disposed between a cap member and a platform of a holder slidably to and from a retracted position and an ejecting member disposed in the gap between the cutting edges of the upper and lower blades, the ejecting member being fixed to the cap member or to the platform at such a position that, when the shaving blade unit has been moved to the retracted position, the cutting edge of the lower blade is flush with or behind the front surface of the ejecting member.

These and other objects, as well as advantageous features of the invention will become more clear from the following description of the preferred embodiments taken in conjunction with the accompanying drawings.

DESCRIPTION OF THE PREFERRED EMBODIMENTS

Figure 1:
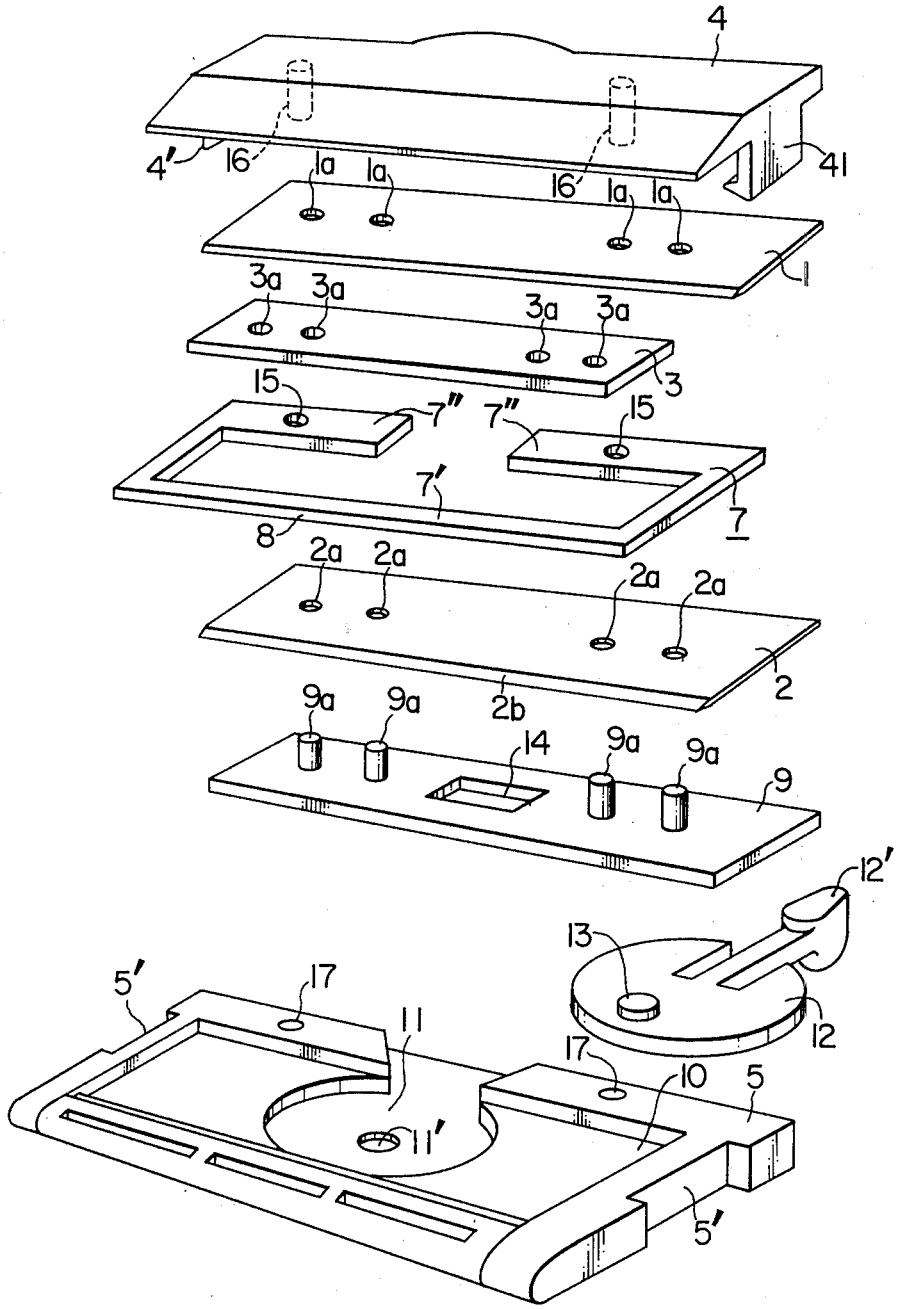
FIG. 1 is an exploded perspective view of a safety razor constructed in accordance with a first embodiment of the invention.
Figure 2:
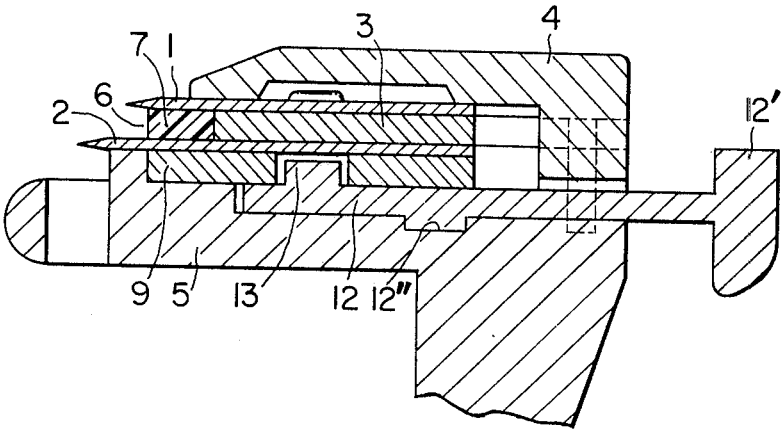
FIG. 2 is a sectional view of an essential part of the safety razor as shown in FIG. 1 in the state of use.
Figure 3:
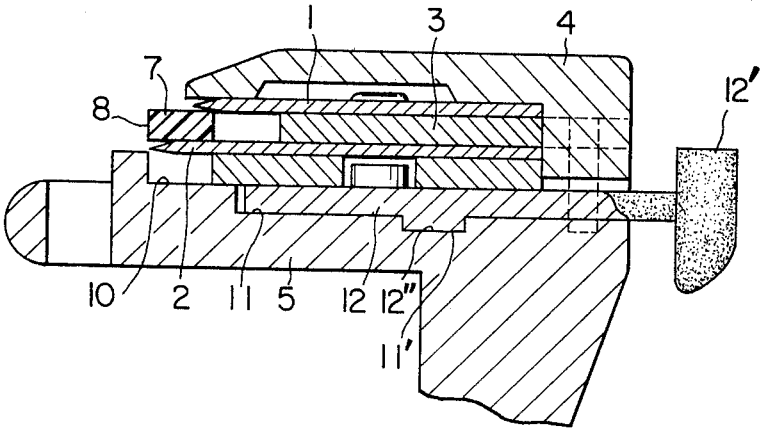
FIG. 3 is a sectional view of an essential part of the safety razor as shown in FIG. 1 in the state out of use.

Referring first to FIGS. 1 to 3 showing a first embodiment of the invention, a holder of a safety razor of the invention has a platform 5 formed preferably integrally therewith. The platform 5 has a rectangular recess 10 formed in the upper surface thereof. The bottom of the recess 10 is further recessed at its central portion to provide a circular depression 11. The platform 5 is further provided with bores 17 adapted for receiving fixing pins 16 of a later-mentioned cap member 4.

The circular depression 11 is further recessed at its central portion as at 11', and is adapted to rotatably receive a circular rotary disc 12 which is provided at its rear end with a knob 12'. In the assembled state, as will be seen from FIGS. 2 and 3, the central recess 11' of the circular depression 11 receives a projection 12'' formed on the lower face of the rotary disc 12. The projection 12'' acts as a dowel. The rotary disc 12 is further provided with a projection 13 formed on the upper face thereof. The projection 13 is offset from the center of the rotary disc 12.

The rectangular recess 10 of the platform 5 is adapted to receive a rectangular blade carrier plate 9. The rear wall of the rectangular recess 10 of the platform 5 is partly cut away to permit the swinging of the knob 12' of the rotary disc 12 when the latter is rotated.

The blade carrier plate 9 is adapted to overlie the rotary disc 12 in the assembled state, as will be seen from FIGS. 2 and 3. In this state, the projection 13 of the rotary disc 12 is slidably received by the central elongated bore 14 formed in the blade carrier plate 9. The blade carrier plate 9 has a width somewhat smaller than that of the rectangular recess 10 of the platform 5 so as to be movable in the latter in the widthwise direction, i.e. in the direction perpendicular to the longitudinal direction thereof. The arrangement is such that, as the rotary disc 12 is rotated in the circular depression 11, the projection 13 is slided along the elongated bore 14, which in turn causes the blade carrier plate 9 to move back and forth in the rectangular recess 10 due to the eccentricity of the projection 13.

The safety razor of the invention has a shaving blade unit which includes an upper blade 1, a lower blade 2 and spacer member 3 interposed therebetween. The lower blade 2, spacer member 3 and the upper blade 1 are superposed and fixed to the blade carrier plate 9. More specifically, in the assembled state, pins 9*a* formed on the blade carrier plate 9 are received by bores 2*a* of the lower blade 2, bores 3*a* of the spacer plate 3 and finally by bores 1*a* of the upper blade 1, thereby to fix the shaving blade unit to the blade carrier plate 9.

A substantially C-shaped ejecting member 7 has a front rib portion 7' which is adapted to be placed in the gap between the upper and the lower blades 1 and 2, while the rear tab portions 7'' of the member 7 which have through bores 15 are positioned behind the shaving blade unit.

A cap member 4 adapted to overlie the upper blade 1 has pins 16 extending downward from the lower face thereof. In the assembled state, the pins 16 of the cap member 4 extends through the through bores 15 of the ejecting member 7 into corresponding holes 17 formed in the upper surface of the platform 5, thereby to fix the ejecting member 7 against movement. Further, the cap member 4 is fixed to the platform 5 with tongues 4', which project downwardly at lateral sides of the cap member 4, engaging recessed portions 5' formed at lateral sides of the platform 5.

The position of the ejecting member 7 is so determined that the cutting edge 2*b* of the lower blade 2 is flush with or behind the front surface 8 of the front rib 7' of the ejecting member 7, when the shaving blade unit is fully retracted as will be explained later.

In use, the knob 12' of the rotary disc 12 is manipulated to rotate the latter in one direction to make the projection 13 of the rotary disc 12 slide along the elongated bore 14 of the blade carrier member 9, which in turn causes a forward movement of the blade carrier plate 9 and, hence, of the shaving blade unit, due to the eccentricity of the projection 13. In consequence, the cutting edges of the upper and lower blades 1, 2 are moved to an advanced, revealed position to permit shaving.

After the shaving, the knob 12' is manipulated to rotate the rotary disc 12 in the opposite direction to make the projection 13 slide along the elongated bore 14 in the opposite direction. In consequence, the blade carrier plate 9 and, accordingly, the shaving blade unit are retracted to make the cutting edges disappear. As the shaving blade unit is moved back to the fully retracted position, the ejecting member 7, which is fixed to the cap member 4 and the platform 5, comes into the space 6 (FIG. 2) between the upper and the lower blades 1, 2 to eject the hairs and other shaved matters from the space between the cutting edges of the upper and lower blades 1, 2. This is because the ejecting member 7 is so located that the cutting edge of the lower blade 2 is positioned flush with or behind the front surface 8 of the front rib 7' of the ejecting member 7 when the shaving blade unit is fully retracted. In this state, the cutting edges of both blades are fully hidden behind the cap member 4 as shown in FIG. 3, so that the safety razor can be handled with enhanced safety and the cutting edges themselves are protected from any damaging external force.

Figure 4:
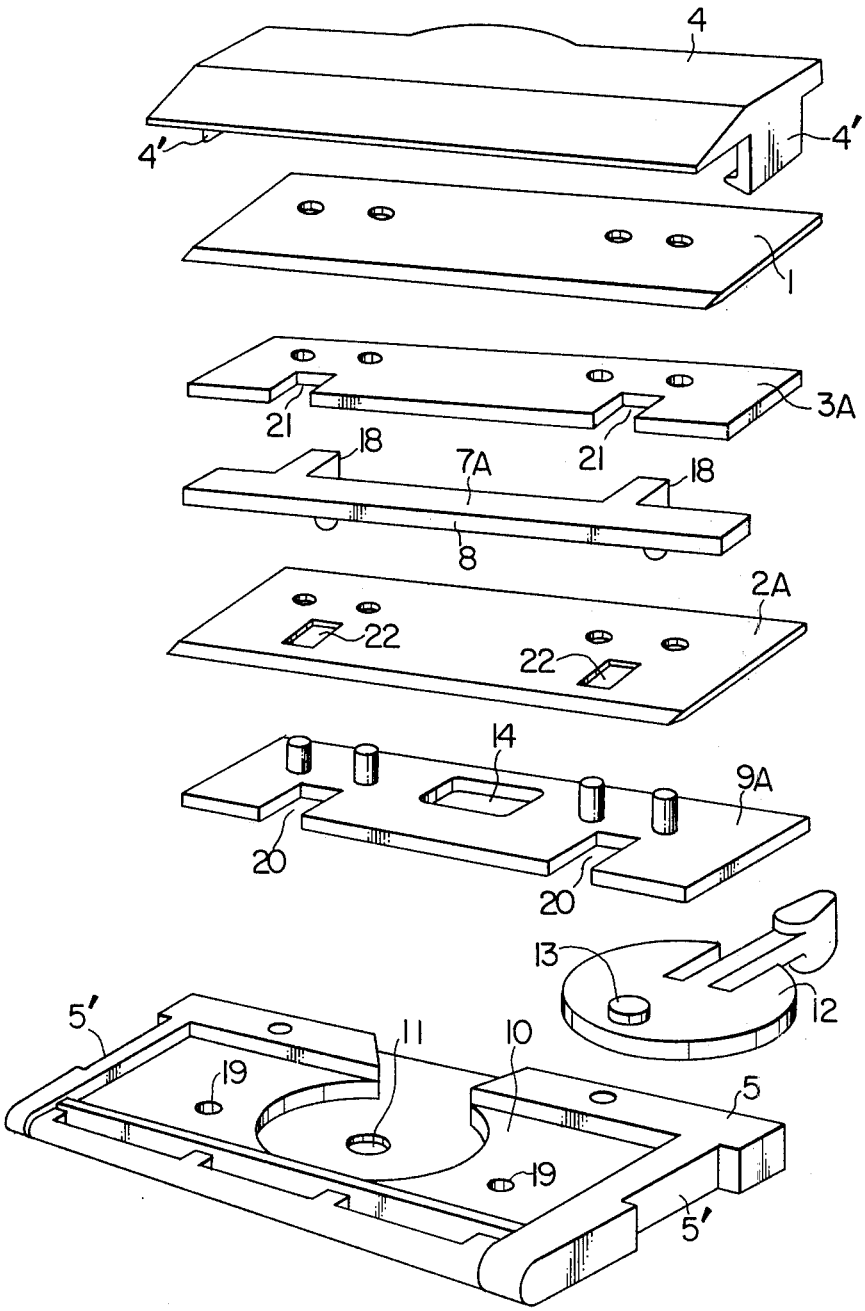
FIG. 4 is an exploded perspective view of a safety razor constructed in accordance with a second embodiment of the invention.
Figure 5:
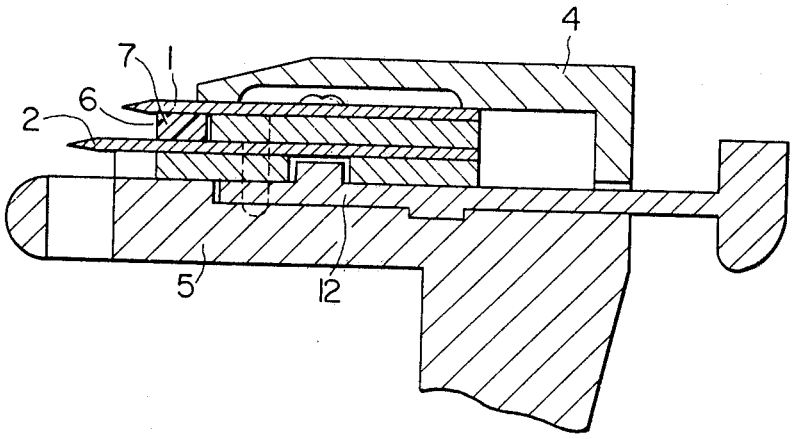
FIG. 5 is a sectional view of an essential part of the safety razor as shown in FIG. 4 in the state of use.
Figure 6:
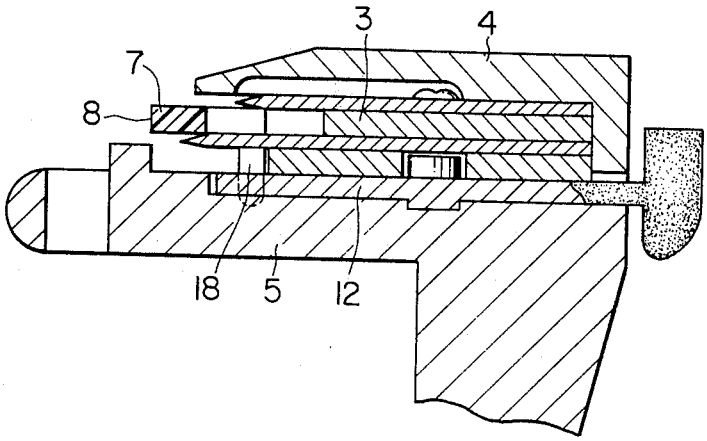
FIG. 6 is a sectional view of an essential part of the safety razor as shown in FIG. 4 in the state out of use.

FIGS. 4 to 6 show a second embodiment of the invention in which same reference numerals are used to denote same parts or members as those of the first embodiment shown in FIGS. 1 to 3. This second embodiment has a construction similar to that of the first embodiment, except the manner of attaching the ejecting member 7A. More specifically, in this second embodiment, the ejecting member 7A is provided with two L-shaped legs 18 formed unitarily therewith. The lower ends of these L-shaped legs 18 are received by corresponding bores 19 formed in the bottom of the rectangular recess 10 of the platform 5.

The blade carrier plate 9A is formed at its portions aligning to the L-shaped legs 18 with notches 20 into which the L-shaped legs 18 are inserted, so that, in the assembled state, the plate 9A may move relatively to the ejecting member 7A. Similarly, the spacer member 3A, and the lower blade 2A are formed with notches 21 and elongated bores 22, respectively, which receive the L-shaped legs 18. Thus, the upper and lower blades 1, 2, spacer member 3 and blade carrier plate 9 are movable relative to the ejecting member 7 which is fixed to the platform 5. In the second embodiment, the pins 16, and the bores 15, 17 for receiving the pins 16 as shown in FIG. 1 are eliminated, and the cap member 4 is fixed to the platform 5 with tongues 4' extending integrally downwardly from lateral sides of the body of the cap member 4 engaging recessed portions 5' formed in lateral sides of the platform 5.

It will be apparent to those skilled in the art that advantages equivalent to those offered by the first embodiment are achieved also by this second embodiment.

Figure 7:
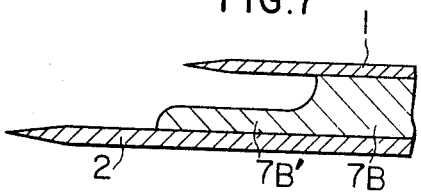
FIG. 7 is a sectional view of an essential part of a safety razor which is a modification of the safety razors shown in FIGS. 1 and 4.

FIG. 7 shows a modification of the safety razor of the invention. In this modification, the spacer member 7B interposed between the upper and lower blades 1 and 2 has a front end portion 7B' of reduced thickness which is formed by partly cut out, substantially in parallel with the planes of the blades, the front end portions of the spacer members of the previously described embodiments. With this structure, the volume of the space between the blades 1 and 2 are increased, so that the larger amount of hairs and other shaved matters are received by the space to reduce the number of ejecting operations required for maintaining the high cutting quality.

Figure 8:
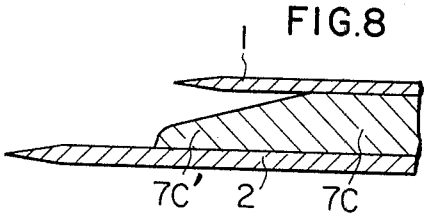
FIG. 8 is a sectional view of an essential part of a safety razor which is another modification.

FIG. 8 shown another modification in which the spacer member 7C has a front end portion 7C' having a thickness gradually increasing from the left end toward the right as viewed in FIG. 8. This end portion 7C' is formed by obliquely cut out front end portions of the spacer members of the previously described embodiments. Also in this another modification, the volume of the space between the blades 1 and 2 are increased. Thus, advantage similar to that produced by the modification shown in FIG. 7 is obtained.

Although the invention has been described through its preferred forms, it is to be noted that the described embodiments are not exclusive and various changes and further modifications may be imparted to the embodiments without departing from the scope of the invention which is limited solely by the appended claims.

What is claimed is:

1. A two-bladed safety razor comprising: a platform connected to a handle; a shaving blade unit including an upper blade, a lower blade and a spacer member interposed between the upper and the lower blades; a blade carrier plate carrying said shaving blade unit; a cap member adapted to overlie said upper blade and fixed to said platform; an ejecting member interposed between the cutting edges of said upper and lower blades and fixed to at least one of said platform and said cap member; and means for causing a movement of said blade carrier plate to and from a fully retracted position relatively to said platform, said ejecting member being so located that the cutting edge of said lower blade is flush with or behind the front surface of said ejecting member when said blade carrier member takes said fully retracted position.

2. A two-bladed safety razor as claimed in claim 1, wherein said movement causing means includes a manually rotatable rotary disc carried by said platform, a projection formed on the upper face of said rotary disc at a distance from the center of the latter, and an elongated bore formed in said blade carrier plate and slidably receiving the projection of said rotary disc.

3. A two-bladed safety razor as claimed in claim 1, wherein said ejecting member is fixed to both of said cap members and said platform by means of pins extending through bores formed therein.

4. A two-bladed safety razor as claimed in claim 1, wherein said ejecting member is fixed only to said platform by means of legs formed integrally therewith.

5. A two-bladed safety razor as claimed in claim 1, wherein said ejecting member is partly cut out at its front end portion to provide a larger space between the cutting edges of said upper and lower blades.

* * * * *